US006463983B1

(12) United States Patent
Lang

(10) Patent No.: US 6,463,983 B1
(45) Date of Patent: Oct. 15, 2002

(54) RETRACTING SCREEN FRAME AND MECHANISM FOR DOOR OR WINDOW

(76) Inventor: Richard A. Lang, 3421 Woodview Dr., Lafayette, CA (US) 94549

( * ) Notice: Subject to any disclaimer, the term of this patent is extended or adjusted under 35 U.S.C. 154(b) by 0 days.

(21) Appl. No.: 09/916,712

(22) Filed: Jul. 26, 2001

(51) Int. Cl.[7] ..... A47H 1/00
(52) U.S. Cl. ..... 160/23.1; 160/273.1
(58) Field of Search ..... 160/23.1, 24, 26, 160/29, 31, 270, 271, 273.1, 282, 285, 287, 41

(56) References Cited

U.S. PATENT DOCUMENTS 4,359,081 A * 11/1982 Brower ..... 160/243
4,651,797 A 3/1987 Langey
4,821,786 A * 4/1989 Johnston ..... 160/23.1
5,505,244 A * 4/1996 Thumann ..... 160/23.1
5,758,704 A 6/1998 Elrod
6,059,007 A * 5/2000 Tomita ..... 160/273.1 X
6,082,432 A * 7/2000 Kissinger ..... 160/273.1 X
6,209,610 B1 * 4/2001 Davies et al. ..... 160/23.1 X

* cited by examiner

*Primary Examiner*—David M. Purol
(74) *Attorney, Agent, or Firm*—George W. Wasson

(57) ABSTRACT

A retracting screen with its mounting and guiding apparatus for a door or window opening. The apparatus includes a housing from which and into which a screen is rolled, a drawbar for withdrawing the screen from the housing and for latching the screen in a closed position, and tracks for guidance of the drawbar across an opening. The housing is aesthetically mounted within a framed opening. The guidance system for the drawbar is adapted to accommodate slight structural variances in an opening by the cooperation between the drawbar structure and the elements of the track.

13 Claims, 5 Drawing Sheets

RETRACTING SCREEN FRAME AND MECHANISM FOR DOOR OR WINDOW

This invention relates to a door or window screen, and more particularly to a horizontally moveable door or window screen or a vertical screen for a window. The screen is rolled up onto and unrolled from a vertically or horizontally oriented roller storage site adjacent to a framed door or window.

BACKGROUND

It has heretofore been proposed to roll upon and unroll door or window screens from a vertically disposed door mechanism or window frame. Typical of such prior art are U.S. Pat. No. 4,651,797 issued Mar. 24, 1987 to A. E. Lange for ROLL-UP SCREEN DOOR; U.S. Pat. No. 5,758,704, issued Jun. 2, 1998 to C. K. Elrod for ROLL-UP SCREEN DOOR APPARATUS; and U.S. Pat. No. 6,082,432, issued Jul. 4, 2000, to D. Kissinger for SCREEN DOOR ACCESSORY.

One significant deficiency of these screens is that the screen installation is dependent on the opening shape, which must be precisely square or provide a perfectly flush surface for mounting. Thus, for example, a door opening in a building that has settled ¼ inch to one side of the opening would present significant difficulty in installing a properly operating screen inside the opening, and though an exterior flush mount system surmounts some of the difficulty with settled foundations or sills, it is still necessary to install the exterior flush mount absolutely square for proper operation. The same difficulties occur with window installations where the window opening has become out of plumb or not horizontal.

Additionally, friction in these systems precludes free operation in many cases.

There is no known satisfactory treatment in the prior art of accommodating opening variances in door and window screen assemblies.

Accordingly, it is an object of this invention to provide an improved, simplified low cost, easy to install, screen door or window closure system advantageous for use in single doors as well as with double pivoted or sliding doors and in openable windows of various construction.

A more specific objective of the invention is to employ a track and roller/low friction system that allows for extreme variances in opening dimensions while still permitting free operation of the system.

Another objective of this invention is to allow for these variances and still provide an effective insect barrier.

THE INVENTION

The screen closure of the present invention is essentially a fabric screen panel of any texture and stiffness that can be rolled up in response to a retraction spring onto a screen storage roller and unwound therefrom to extend as a planar sheet screen tautly disposed across a door or window opening. In the case of the door screen, the top and bottom screen edges to be horizontally extended across the door opening are typically carried by a drawbar with end caps to ride in top and bottom channel tracks secured to the door framework for retaining and guiding the respective top and bottom screen edges across the door opening between vertical doorpost frames upon which the screen door of this invention is mounted. In the case of the window screen rolled horizontally, the mechanism is the same. In the case of a window screen rolled vertically, the vertical side edges extend across the window opening framework for retaining and guiding the screen edges across the window opening between horizontal window frame members.

Accordingly, a horizontally movable vertically disposed drawbar having a grasping handle affixed thereto, or a finger pocket slot routed therein, is secured to the outer end of the rolled up screen panel, by suitable means such as an extruded spline. The drawbar has end caps on opposite ends for riding on top and bottom horizontally oriented tracks defined by generally U-shaped channel members. In these channels, an insect impeding member such as commercial weatherstripping is disposed inwardly on the channel side opposite the track.

A stabilizing mechanism provided by end caps at both ends of the drawbar is supplied with internally disposed spring loaded roller or low friction sleeves to ride upon the respective top and bottom surfaces of the tracks. The rollers or low friction sleeves and track are kept in contact by the roller housing/low friction sleeve surrounding a portion of the track and roller housing/low friction sleeve spring. Thus, the drawbar rides smoothly across the door opening in response to manual actuation in a vertical posture without binding, while accommodating wide variances in opening dimensions as the screen is opened and closed. A spring mechanism in the screen storage roller assembly serves to retract the screen so the drawbar may be manually or mechanically returned to the roller side in a housing. Either retraction method brings the drawbar into contact with the housing snubbers, cushioning the drawbar inpact with the housing, and reducing the noise and mechanical stress associated with mechanical closing.

The housing encloses biased screen storage roller mechanism for storing the rolled fabric screen panel and for releasing the panel to extend across an opening. The housing enclosure includes a novel convenient mounting structure for mounting the housing enclosure onto a framed opening.

Thus the screen door provided by this invention achieves the foregoing objectives of resolving deficiencies of the prior art to provide a different mode of operation, better installation and operation characteristics, and minimal complexity and construction cost.

Further objects and features will be readily apparent to those skilled in the art from the appended drawings and specification illustrating preferred embodiments of the invention wherein:

THE PREFERRED EMBODIMENT

Figure 1:
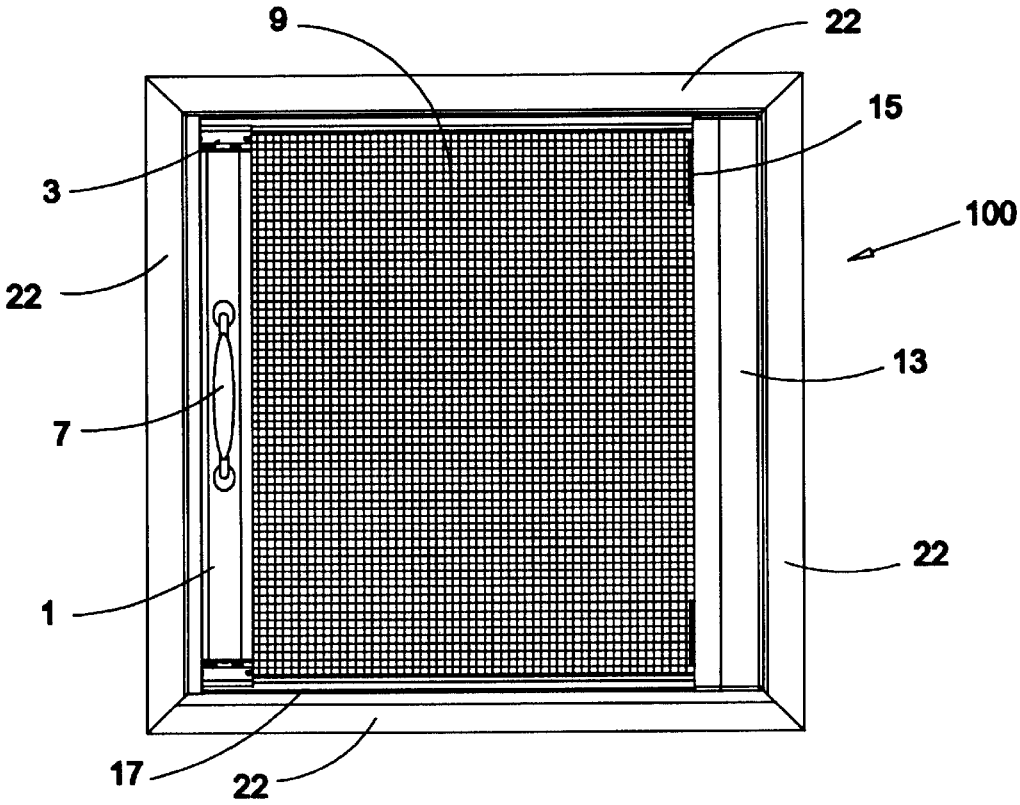
FIG. 1 is a front view of an installed screen door as afforded by this invention where the screen is resident in the fully closed position in front of a door opening embodiment provided with a single door.
Figure 1A:
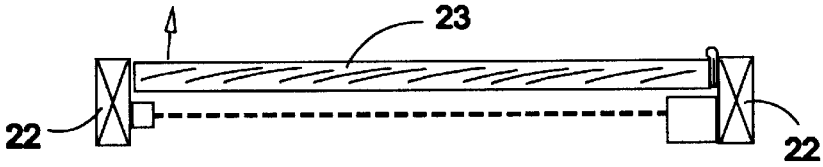
FIGS. 1A, 1B and 1C are vertical sections respectively through a door assembly hinged at the right side, a sliding door with a panel sliding to the right, and a two panel door with elements hinged at the right and left sides.
Figure 1B:
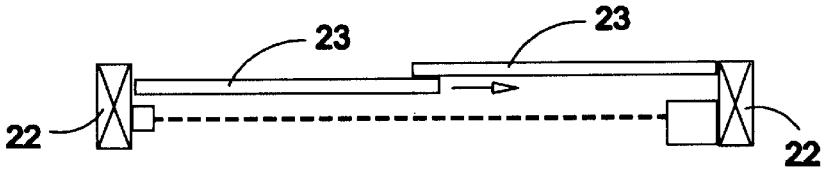
Figure 1C:
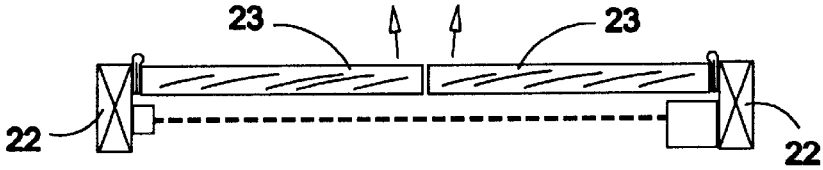

With reference to the accompaning drawings, the roll up screen door 100 of this invention has a screen panel 9 rolled onto a supply roller 10, which is spring biased by the helically coiled spring 11, located within supply roller 10 in supply roller housing end cap 14, thereby to retract the screen panel 9 onto the supply roller 10. Conversly this structure permits the screen panel 9 to be manually with drawn by movement of the drawbar 1 to a closed position when the drawbar 1 is positioned adjacent to a door framework 22 surrounding one or more doors 23. These doors may be either pivoted in nature or sliding doors. Note that a favorable feature of this invention is that the track system 17 may be mounted in a door opening that varies dimensionally from end to end as shown in FIG. 1, thereby allowing the screen to still operate freely.

Figure 2:
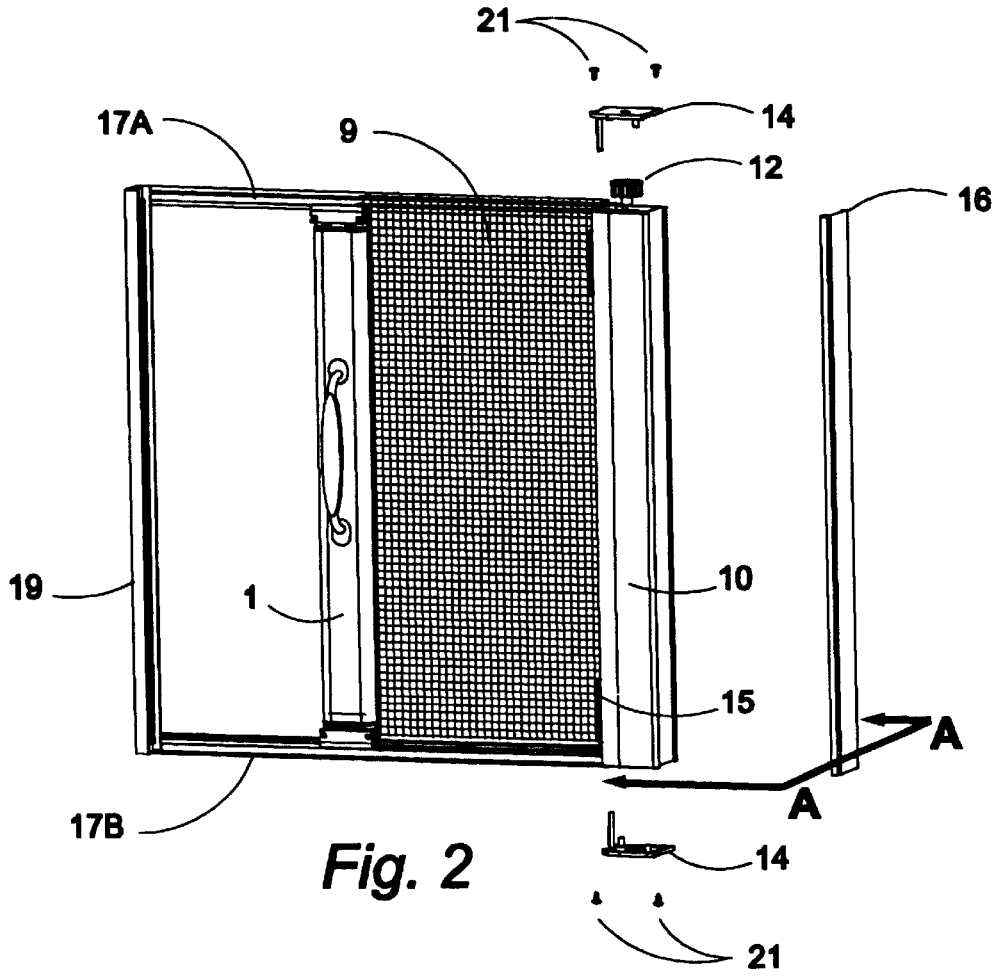
FIG. 2 is an exploded perspective view of the substantially rectangular screen framework of FIG. 1 showing the screen being unrolled from a vertical roller housing located at the right side.
Figure 5:
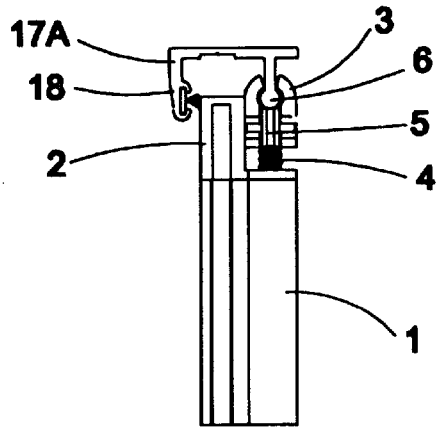
FIG. 5 is an end sectional view looking into the upper horizontally disposed screen guiding track of FIG. 2.
Figure 6:
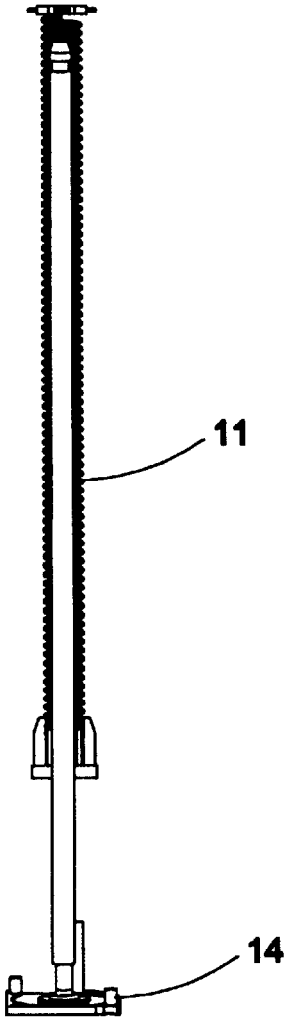
FIG. 6 is a lower sectional view looking upwardly in FIG. 2 at helical biasing spring carried by the roller housing/low friction sleeve cap.
Figure 7:
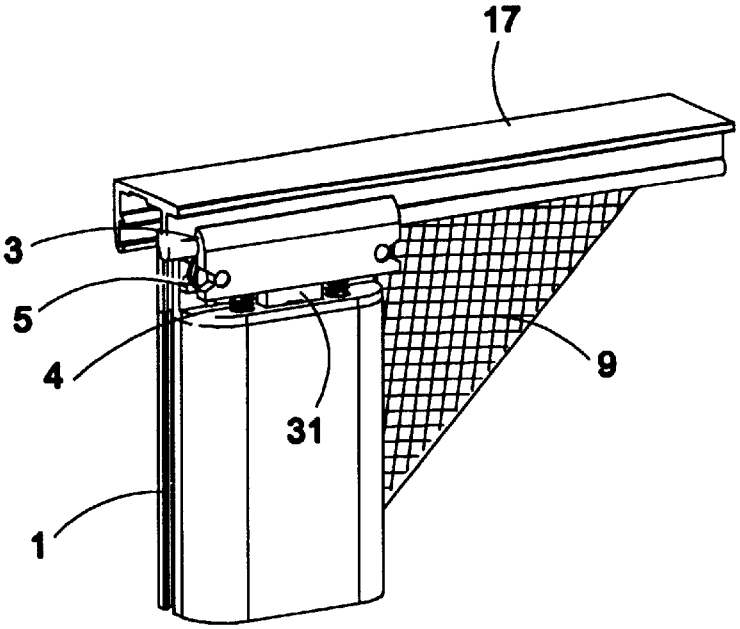
FIG. 7 is a perspective view illustrating the interaction between the sliding screen drawbar and guidance channel for retaining the screen, and the roller housing/low friction sleeve spring assembly for accommodating opening dimensional variations.
Figure 9:
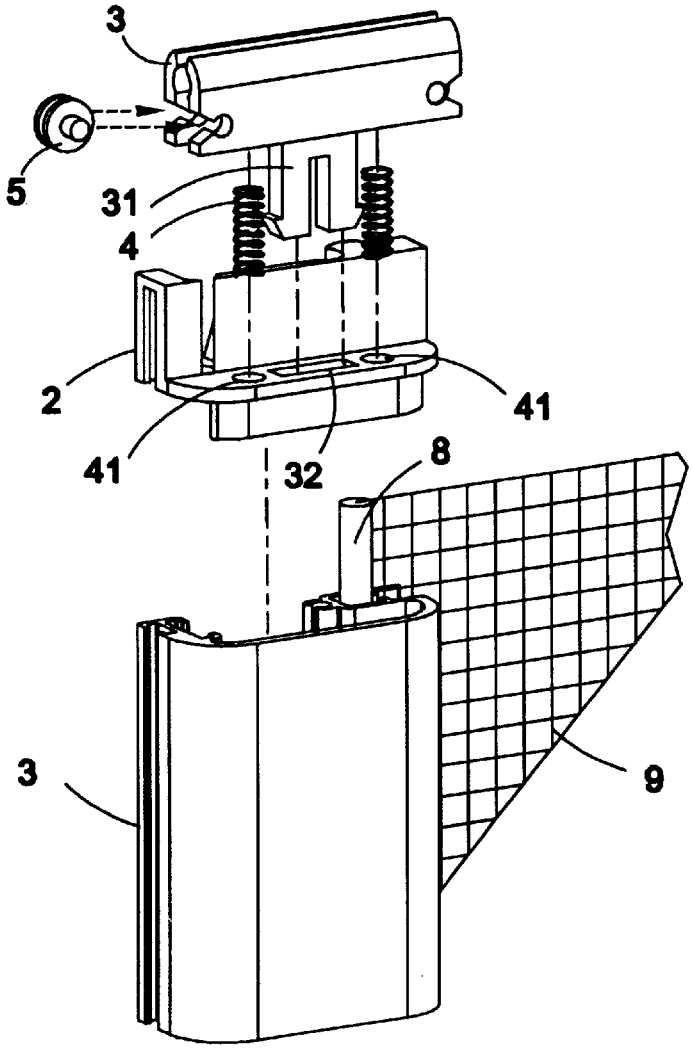
FIG. 9 is an exploded sectional view illustrating the drawbar, drawbar end cap, and roller housing/low friction sleeve components, and their respective interactions in providing drawbar stabilization, opening dimensional variation, and non-binding operation .

The mechanism for accommodating various opening dimensions is best visualized from FIGS 5, 7 and 9. Thus, a vertically disposable drawbar 1, having a manual actuation handle 7 or fitted with an inset mechanical latch handle, is disposed at the distal end of the screen panel 9, where it surrounds a spline 8 on the screen panel. As illustrated in FIG. 2, the drawbar 1 is manually movable horizontally to with draw the screen from the supply roller 10.

FIGS. 1 and 2 illustrate a framework for positioning the screen panel 9 across the span of the door framework 22 with the supply roller 10 disposed vertically at one horizontal end of the framework and two channel horizontal U-shaped tracks 17A and 17B for mating engagement with the drawbar 1 to guide the screen panel 9 across the span of the door opening as the screen panel 9 is withdrawn from the supply roller 10.

It should be understood that door framework 22 of FIG. 1 is the finished framing around a door opening that includes internal vertical studs at the sides, a header at the top and a sill at the bottom of the opening. Hinged doors have door stops at the interior finished opening and sliding doors have frames for the sliding panels. The retracting screen frame and mechanism of the present invention is installed in the finished framed door opening with, in the case of a vertical door, the screen roller housing at one side, a latch mechanism at the opposite side, and track structures adjacent to the header at the top and the sill at the bottom.

FIG. 5 illustrates the structure at the top of the retracting screen mechanism adjacent to a door header. For mating inside the U-shaped channel of track 17A, a substantially curved roller housing/low friction sleeve 3 is disposed at the upper tip of the drawbar 1, for entering the upper channel and for grasping track 17A, thereby to retain the screen panel 9 tautly as aided by the tension from spring biased roller 10. A duplicate structure attaches the lower tip of the drawbar to the U-shaped channel 17B.

From the top surface end of the drawbar 1 extends the spring loaded roller housing/low friction sleeve 3, which rides on. The cylindrical exterior surface of the U-shaped channel of track 17A and 17B in the bottom track, to facilitate horizontal drawbar movement with the drawbar 1 vertically inclined. The generally hollow cylindrical tip configuration of the roller housing/low friction sleeve from which the roller housing/low friction sleeve 3 extends serves to maintain the drawbar vertically oriented. The wheels 5 minimize friction between the roller housing/low friction sleeve 3 and track 17 and prevent binding. Spring 4 keeps constant tension on the roller housing/low friction sleeve 3, accommodating variations in openings and providing drawbar stability. The springs 4 are held in tension by pockets 41 in the drawbar end caps 2 by integral flexural barbs 31 mating with slots 32 as seen in FIG. 9. A feature of this invention is that slight slanting or tilting of the drawbar, in a rotary or pivotal motion, can be accommodated by the structure without binding between the drawbar and the track during operation, and without detriment to the rolling screen door system as a whole.

Figure 9A:
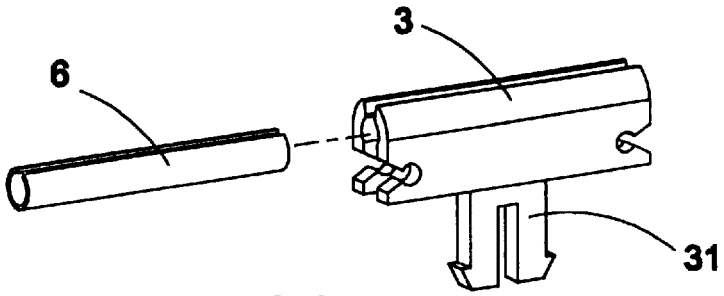
FIG. 9A is an exploded perspective of an alternative form for low friction drawbar construction.

An alternative to the roller construction shown in FIG. 9 for low friction cooperation between sleeve 3 and tracks 17 can be accomplished with a low friction sleeve insert 6 into the hollow interior of the roller housing/low friction sleeve 3. The sleeve insert is shown in FIG. 9A in an exploded perspective. Low friction sleeve insert 6 is formed of a material containing a lubricant or a plastics material having inherent low surface friction characteristics such as teflon. The insert 6 is held in the hollow cylindrical interior of sleeve 3 by the inherent bias of its construction outwardly against the interior of the sleeve and extends axially along the sleeve to establish an extended axial cooperation between the sleeve and the track 17 along the insert 6. Springs 4 maintain the low friction cooperation between the insert 6 and the track 17 while permitting limited flexure rotational movement of the end cap 2 and any uneven construction at the framed opening.

Figure 8:
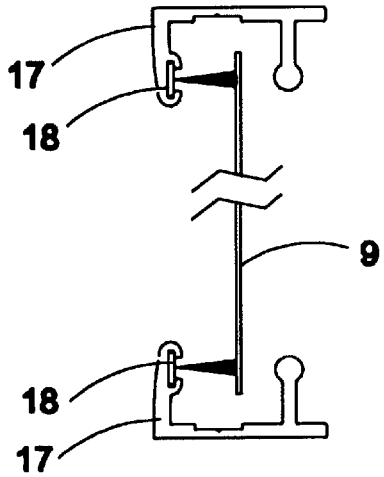
FIG. 8 is an end sectional view looking into the horizontally disposed screen tracks of FIG. 2, showing the weatherstripping in its role as an insect barrier.

The upper and lower edges of the screen panel 9 are held in tension by the drawbar 1 and the spring biased roller 10 to present taught edges to engage the weatherstripping 18 extending inwardly toward the screen panel 9 from the inside of the track 17 sidewall, FIGS. 5 and 8. This constitutes insect impeding structure, and is disposed along the horizontal track across the span of the door to keep insects from passing through or around the screen panel and to resist gapping caused by contact with the extended screen surfaces.

Figure 10A:
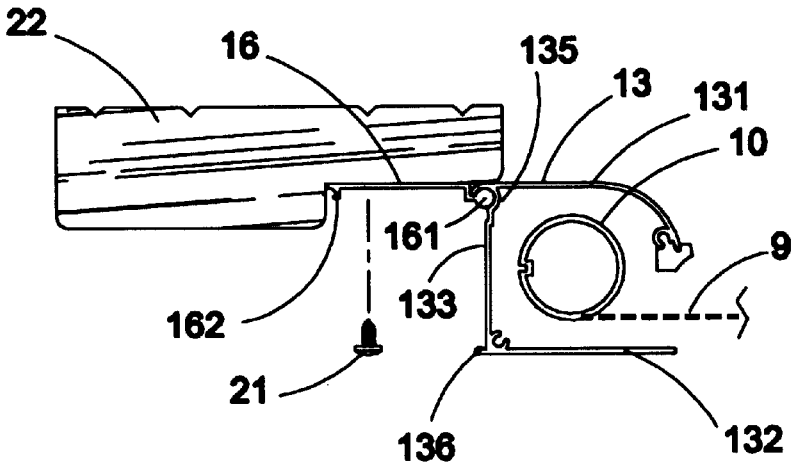
FIG. 10A is an end fragmental view looking into the vertically disposed housing, showing the hinge butted against a typical door jamb, the housing swung out on the hinge to allow the installation screws to be driven into the door frame member.
Figure 10B:
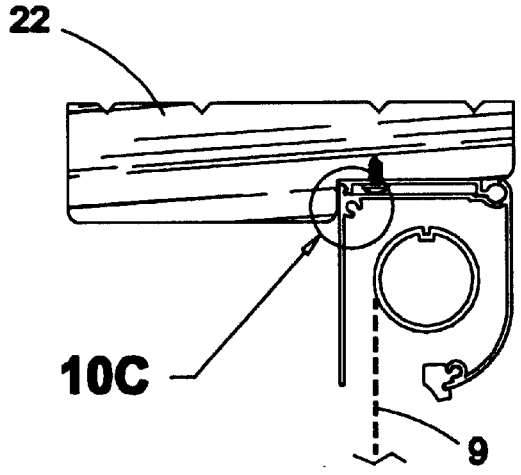
FIG. 10B is similar to the sectional view of FIG. 10A showing the installation screws driven into the framing member, and the housing swung closed and locked.
Figure 10C:
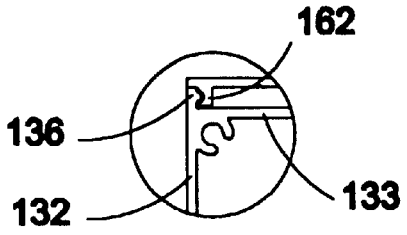
FIG. 10C is an enlarged detail of the circled portion of FIG. 10B and illustrating the snap hinge lock shown engaged.

As shown in FIGS. 10A, 10B and 10C, the housing 13 comprises a generally U-shaped form with legs 131 and 132 and a bight portion 133. At the outer junction of leg 131 and bight 133 an exterior U-shaped channel 135 is formed.

Hinge 16 is formed with a tubular end bar 161 at one end and a latch finger 162 at the opposite end. Tubular end bar 161 mates with the interior of U-shaped channel 135 to provide a hinged support between the housing 13 and the hinge 16.

At the outer junction of leg 132 and the bight 133 an interior nib 136 is formed. The nib 136 mates with latch finger 162 to releasably spring lock the housing 13 in closed position as shown in FIGS. 10B and 10C.

The free end of leg 131 is formed with a bend toward the free end of leg 132 and is formed with an accommodating groove for attachment of a protective and housing snubber surface 15 for preventing damage to the screen panel 9 by a sharp edge of leg 131 and as a buffer for the drawbar 1 as it is retracted with the screen panel forward the housing 13.

Figure 4:
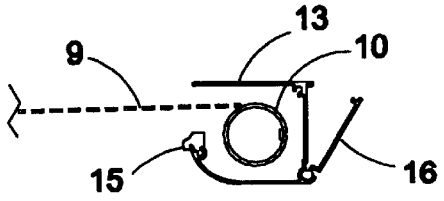
FIG. 4 is a top sectional view of the screen storage roller and surrounding housing member taken along the lines A—A of FIG. 2 and showing the installation hinge in a partially open position.

As seen from FIGS. 2 and 4, the accessory framework provides a substantially U-shaped supply housing 13 about the supply roller 10 with top and bottom removable caps 14 for retaining the housing. A feature of this invention is that installation hinge 16 provides for fastening the housing 13 to a doorframe site with ease and accuracy as shown in FIGS. 10A, 10B and 10C. The hinge 16 is butted against a door frame member 22, screws 21 are installed, and the housing 13 is rotated to snap the hinge lock in place. The hinged installation provides for ease of mounting and an aesthetically clean appearance with no exposed mounting screws.

The end caps 14 are journaling members permitting the supply roller 10 to rotate during withdrawal and retracation of the screen panel 9.

One of the end caps 14 carries the spring 11 as the roller's spring-biasing structure disposed within the supply roller 10. Thus, in effect there is affixed to cap members 14 the spring 11 with its outer end disposed through the slot in cap 14 and the inner end ready for mating with supply roller 10. The inner end of the spring 11 and the upper end of the supply roller 10 thus have mutually mating fittings for engaging the supply roller to the spring, thereby serving to roll up the screen panel 9; upon the roller 10 and permitting, retraction of the screen panel 9.

Note that the upper cap 14 is attached by screws 21 to the housing 13 as shown in FIG. 2. In order to vary tension on the screen panel 9, the helical spring 11 may be rotated in several settings by turning the cap 360° or more before the cap 14 is attached to the roller 16 and housing 13.

Figure 3:
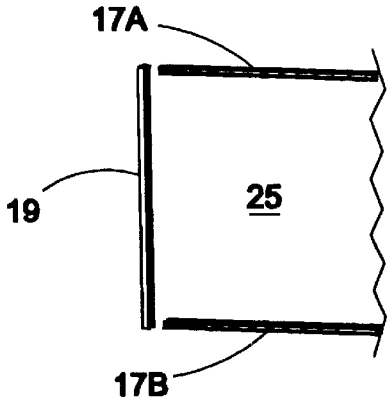
FIG. 3 is an exploded view of interconnection of framework members in a screen door embodiment showing the tracks 17A and 17B pocketing in the closer strip 19 looking toward the left side of the screen framework as seen in FIG. 2.

As may be seen from FIG. 3, the rectangular framework is constructed of several structural members, preferably of 1Light aluminum extrusions, which connect in assembled form by appropriate welding or fasteners. Thus the top U-shaped track 17A and the bottom U-shaped track 17B are connected by the closer strip 19 at the end opposite to the screen supply roller 10 to define the opening 25 into which the screen 9 may be closed or withdrawn.

While certain preferred embodiments of the invention have. been specifically disclosed, it should be understood that the invention is not limited thereto as many variations will be readily apparent to those skilled in tha are ant the invention is to be given its broadest possible interpertation within the terms of the following claims.

I claim:

1. a roll-up screen apparatus for a framed opening having a pair of spaced first frame members and a pair of spaced second frame members, said first frame members being substantially parallel, said second frame members extending between said first frame members, said roll-up screen apparatus comprising, a) a flexible screen including a first screen end, a second screen end, a screen first edge, and a screen second edge, b) a housing for said flexible screen, said housing being adapted to be attached to one of said first pair of spaced parallel frame members, c) said housing including an axial supply roller rotatably supported at each axial end, said first screen end attached axially to said supply roller, spring bias means attached to said supply roller, said spring bias being arranged to rotate said supply roller to roll said screen onto said supply roller, d) a pair of track frame members adapted to be attached to said pair of spaced second frame members, one of said pair of track frame members attached to each of said pair of spaced frame members, e) a drawbar having a body portion extending axially substantially parallel to said housing, drawbar end cap elements at opposite axial ends of said body portion, said second screen end being attached to said drawbar body portion axially along said drawbar so as to be parallel to the axis of said supply roller, f) each of said drawbar end cap elements including flexibly connected sleeve portions permitting axial movement and pivotal movement of said drawbar end cap elements with respect to said drawbar body portion, g) said drawbar end caps elements and sleeves including means for sliding engagement with said track frame members, said sliding engagement permitting said axial and pivotal movement of said drawbar end caps with respect to said drawbar body portion while maintaining said sliding engagement with said track frame members.

2. The roll-up screen apparatus of claim 1 wherein said housing includes a hinged portion adapted for attaching said housing to said one of said first pair of spaced parallel frame members.

3. The roll-up screen apparatus of claim 2 wherein hinged portion includes an axially slidable connection between said hinged portion and the body portion of said housing.

4. The roll-up screen apparatus of claim 1 wherein housing includes a pair of supply roller end caps, at least one of said supply roller end caps being removable for permitting axial insertion of said said supply roller into said housing.

5. The roll-up screen apparatus of claim 4 wherein one of said pair of housing end caps includes an adjustable connection to said spring means biasing said supply roller and said one of said end caps for adjusting the rotational spring bias of said supply roller for rolling said screen onto said roller.

6. The roll-up screen apparatus of claim 5 wherein said spring means biasing said supply roller is a helically coiled spring.

7. The roll-up screen apparatus of claim 2 wherein housing includes an axial opening extending the axial length of said housing as an entry and exit opening for said screen from said housing.

8. The roll-up screen apparatus of claim 7 wherein said axial opening includes a snubber and cushioning surface axially along said a opening.

9. The roll-up screen apparatus of claim 1 wherein said pair of track frame members are substantially U-shaped including an interior bight portion for accommodating said screen edges within said bight portion, a track surface along one leg of said U-shape for engagement with said drawbar end caps, and a sealing/weatherstripping surface along the other leg of said U-shape for engagement with said screen edges.

10. The roll-up screen apparatus of claim 1 wherein said drawbar end caps include an elongated U-shaped portion having an elongated axis perpendicular to the axis of said supply roller, said U-shaped portion adapted to be in sliding engagement with said track frame members.

11. The roll-up screen apparatus of claim 10 wherein said drawbar end caps include a pair of rollers supported in said drawbar end caps, said rollers being adapted to engage said track members, said rollers and said U-shaped portion maintaining positive sliding engagement of said drawbar end caps with said track frame members while permitting pivotal movement of said drawbar end caps with respect to said drawbar body portion.

12. The roll-up screen apparatus of claim 10 wherein said drawbar end caps include a lubricant insert within U-shaped portion, said insert maintaining positive sliding engagement of said end caps with said track frame members while permitting pivotal movement of said end caps with respect to said drawbar body portion.

13. The roll-up screen apparatus of claim 10 wherein said drawbar end caps include a body portion having an axially oriented mounting slot, said U-shaped portion includes a barbed mounting tab, said tab being oriented axially with said mounting slot and said barbs adapted to permit entry of said mounting tab into but to prevent withdrawal from said mounting slot, a pair of springs positioned within said drawbar end caps body portion, said U-shaped including pockets for positioning said springs within said body portion, said springs being compressed between said U-shaped portion and said body portion when said barbed mounting tab is engaged with said mounting slot, said spring biased engagement of said U-shaped portion with said body portion permitting said axial movement and pivotal movement of said end caps with respect to said drawbar body portion while maintaining sliding engagement with said track frame members.

* * * * *